US012195955B1

(12) United States Patent
Li

(10) Patent No.: US 12,195,955 B1
(45) Date of Patent: Jan. 14, 2025

(54) METHOD OF MOUNTING WATER OUTLET DEVICE, WATER OUTLET DEVICE, AND THUMB NUT

(71) Applicant: Yuanyuan Li, Suzhou (CN)

(72) Inventor: Yuanyuan Li, Suzhou (CN)

( * ) Notice: Subject to any disclaimer, the term of this patent is extended or adjusted under 35 U.S.C. 154(b) by 0 days.

(21) Appl. No.: 18/791,663

(22) Filed: Aug. 1, 2024

(30) Foreign Application Priority Data

Jul. 23, 2024 (CN) ..... 202421754431.2

(51) Int. Cl.
*E03C 1/04* (2006.01)

(52) U.S. Cl.
CPC ..... *E03C 1/0401* (2013.01)

(58) Field of Classification Search
CPC ..... E03C 1/0401
USPC ..... 4/695
See application file for complete search history.

(56) References Cited

U.S. PATENT DOCUMENTS 8,991,425 B2 * 3/2015 DeVries ..... E03C 1/0403 4/695
9,702,126 B1 * 7/2017 Feher ..... E03C 1/0403
9,835,281 B2 * 12/2017 Pitsch ..... E03C 1/0403
2013/0280007 A1 * 10/2013 Chen ..... E03C 1/0401 411/221
2014/0345724 A1 * 11/2014 Cai ..... F16K 27/0263 137/603
2019/0071848 A1 * 3/2019 Darocha ..... E03C 1/0401
2024/0093817 A1 * 3/2024 Yan ..... F16L 37/252

* cited by examiner

*Primary Examiner* — Huyen D Le

(74) *Attorney, Agent, or Firm* — Daniel M. Cohn; Howard M. Cohn

(57) ABSTRACT

A method of mounting a water outlet device, including passing a valve threaded body of at least one regulating valve and pipes from a top portion of a sanitary appliance countertop to a lower portion of the sanitary appliance countertop, where the valve threaded body of the at least one regulating valve is disposed at a lower end of the at least one regulating valve and is disposed out of a valve body of the at least one regulating valve and the pipes extend downward, sleeving a first thumb nut onto the pipes and the valve threaded body of the at least one regulating valve from bottom to top at the lower portion of the sanitary appliance countertop, and manually tightening the first thumb nut to fix the at least one regulating valve on the sanitary appliance countertop.

19 Claims, 6 Drawing Sheets

METHOD OF MOUNTING WATER OUTLET DEVICE, WATER OUTLET DEVICE, AND THUMB NUT

TECHNICAL FIELD

The present disclosure relates to the field of sanitary equipment, and in particular to a sanitary appliance for water outlet and a mounting method thereof.

BACKGROUND

Currently, mounting and detaching of faucets of water outlet devices are inconvenient since tools, such as wrenches, screwdrivers, etc., are generally required to mount or detach faucet main bodies, gaskets, and nuts. Especially for a three-hole faucet of a basin, mounting or detaching the three-hole faucet is time-consuming and laborious, which has strict requirements on operators and is not beneficial for improving working efficiency.

Chinese patent No. CN212772632U discloses a split type faucet for a basin, including a main body, a threaded tube, a corrugated tube, a second soft tube, and a second gasket. The threaded tube is disposed at one side of a top end of the main body, the corrugated tube is disposed at one end of an interior of the main body, one end of the corrugated tube extends out of the main body, a first gasket is sleeve on a first surface of the corrugated tube, and a first locking screw nut is sleeved on a second surface of the corrugated tube at one side of the first gasket. First round head screws are fixed to both sides of a bottom end of the first locking screw, a first soft tube is connected to one side of a bottom end of the corrugated tube, the second soft tube is disposed adjacent to the first soft tube and is connected to the bottom end of the corrugated tube, and a switch valve body is disposed at a top end of the second soft tube. However, there are technical defects as follows. The main body of the split type faucet and the switch value main body are both fixed to the basin through the gaskets and locking screw nuts, and round head screws are provided to lock the locking screw nuts; when mounting the split type faucet on the basin, tools, such as a wrench and a screwdriver are additionally required for operation in a narrow space below the basin, which wastes time and labor and further has low mounting efficiency.

SUMMARY

The present disclosure provides a method of mounting a water outlet device, the water outlet device, and the thumb nut, aiming to simply mount the water outlet device and more stably fix the water outlet device on a sanitary appliance countertop, thereby reducing labor intensity and improving working efficiency.

In order to solve above technical problems, the present disclosure provides the method of mounting the water outlet device, including following steps.

S10: passing a valve threaded body of at least one regulating valve and pipes from a top portion of a sanitary appliance countertop to a lower portion of the sanitary appliance countertop, where the valve threaded body of the at least one regulating valve is disposed at a lower end of the at least one regulating valve and is disposed out of a valve body of the at least one regulating valve and the pipes extend downward.

S20: manually sleeving a first thumb nut onto the pipes and the valve threaded body of the at least one regulating valve from bottom to top at the lower portion of the sanitary appliance countertop.

S30: manually tightening the first thumb nut to fix the at least one regulating valve on the sanitary appliance countertop.

Furthermore, in the S10, the at least one regulating valve includes a hot water valve and a cold water valve, the pipes include a hot water inlet pipe extending downward, a cold water inlet pipe extending downward, a hot water outlet pipe extending downward, and a cold water outlet pipe extending downward, and an assembly step of the hot water valve, the cold water valve, and the pipes is as follows.

S11: passing the valve threaded body of the hot water valve, the hot water inlet pipe, and the hot water outlet pipe from the top portion of the sanitary appliance countertop to the lower portion of the sanitary appliance countertop, where the valve threaded body of the hot water valve is disposed at a lower end of the hot water valve.

S12: passing the valve threaded body of the cold water valve, the cold water inlet pipe, and the cold water outlet pipe from the top portion of the sanitary appliance countertop to the lower portion of the sanitary appliance countertop, where the valve threaded body of the cold water valve is disposed at a lower end of the cold water valve.

Furthermore, the method of mounting the water outlet device further includes following steps.

S40: passing a spout threaded body of a faucet spout and a spout water inlet pipe from the top portion of the sanitary appliance countertop to the lower portion of the sanitary appliance countertop, where the spout threaded body of the faucet spout is disposed at a lower end of the faucet spout and the spout water inlet pipe extends downward.

S50: manually sleeving a second thumb nut onto the spout water inlet pipe and the spout threaded body of the faucet spout from the bottom to the top at the lower portion of the sanitary appliance countertop.

S60: manually tightening the second thumb nut to fix the faucet spout on the sanitary appliance countertop.

Furthermore, the method of mounting the water outlet device further following steps.

S70: connecting a first horizontal quick coupling of a three-way pipe to a distal end of the hot water outlet pipe at the lower end of the hot water valve.

S80: connecting a second horizontal quick coupling of the three-way pipe to a distal end of the cold water outlet pipe at the lower end of the cold water valve.

S90: connecting a vertical quick coupling of the three-way pipe to a distal end of the spout water inlet pipe.

The present disclosure further provides the water outlet device capable of being quickly mounted, including at least one regulating valve, at least one first thumb nut, and pipes. The at least one regulating valve includes a valve body, the valve body is disposed on a sanitary appliance countertop and is configured to control a water flow rate of the water outlet device. The at least one regulating valve further includes a valve threaded body, the valve threaded body is disposed at a lower end of the at least one regulating valve, the valve threaded body passes through the sanitary appliance countertop from a top portion of the sanitary appliance countertop to a lower portion of the sanitary appliance countertop, and the at least one first thumb nut is configured to be manually tightened to fix the at least one regulating valve on the sanitary appliance countertop. The pipes extend downward.

Furthermore, the pipes include at least one valve water inlet pipe and at least one valve water outlet pipe. The at least one valve water inlet pipe and the at least one valve water outlet pipe are fixed in the valve threaded body of the at least one regulating valve, both the at least one valve water inlet pipe and the at least one valve water outlet pipe extend downward. A distal end of the at least one valve water inlet pipe is a first male connector, and a distal end of the at least one valve outlet pipe is a second male connector.

Furthermore, the water outlet device further includes a faucet spout and a second thumb nut. A spout threaded body of the faucet spout passes through the sanitary appliance countertop and is disposed at the lower portion of the sanitary appliance countertop, the second thumb nut is manually tightened to fix the faucet spout on the sanitary appliance countertop. A spout water inlet pipe is disposed in the spout threaded body of the faucet spout, the spout water inlet pipe extends downward, and a distal end of the spout water inlet pipe is a third male connector.

Furthermore, the at least one regulating valve includes a hot water valve and a cold water valve, the hot water valve and the cold water valve are respectively disposed at two sides of the faucet spout, the at least one valve water inlet pipe includes a hot water inlet pipe and a cold water inlet pipe, and the at least one valve water outlet pipe includes a hot water outlet pipe and a cold water outlet pipe. The hot water inlet pipe and the hot water outlet pipe are disposed at a lower end of the hot water valve, the hot water inlet pipe is communicated with a hot water source, and the hot water outlet pipe is communicated with the spout water inlet pipe. The cold water inlet pipe and the cold water outlet pipe are disposed at a lower end of the cold water valve, the cold water inlet pipe is communicated with a cold water source, and the cold water outlet pipe is communicated with the spout water inlet pipe.

Furthermore, the water outlet device further includes a three-way pipe, the three-way pipe includes a first horizontal quick coupling, a second horizontal quick coupling, and a vertical quick coupling, the first horizontal quick coupling, the second horizontal quick coupling, and the vertical quick coupling are all female connectors and are configured to mix cold water and hot water. The first horizontal quick coupling is configured to connect to a distal end of the hot water outlet pipe, the second horizontal quick coupling is configured to connect to a distal end of the cold water outlet pipe, and the vertical quick coupling is configured to connect to the distal end of the spout water inlet pipe.

The present disclosure further provides the thumb nut for mounting the water outlet device as foregoing, including an annular plate, a columnar nut main body, and a hexagonal bottom sleeve. The annular plate, the columnar nut main body, and the hexagonal bottom sleeve are vertically and coaxially connected in sequence. A height of the columnar nut main body is greater than an external diameter of the columnar nut main body, which is convenient for users to manually rotate. The annular plate is configured to increase a friction area for preventing loosening after tightening the thumb nut, and an inner edge of the annular plate is connected to a top portion of the columnar nut main body. The hexagonal bottom sleeve is configured to increase a running torque when tightening the thumb nut, a top portion of the hexagonal bottom sleeve is connected to a bottom portion of the columnar nut main body.

Furthermore, reinforcing ribs are disposed between an outer surface of the columnar nut main body and a lower surface of the annular plate, and the reinforcing ribs are configured to improve rigidity of the annular plate.

Furthermore, each of the reinforcing ribs includes a radial edge, an axial edge, and a curved edge. Each radial edge radially extends along the lower surface of the annular plate. Each axial edge is connected to a corresponding radial edge and extends along a corresponding generatrix of the columnar nut main body. Each curved edge is curved inward and is respectively connected to an end of the corresponding radial edge and an end of a corresponding axial edge.

Furthermore, an internal thread is disposed on an inner hole wall of an upper section of the columnar nut main body, and the internal thread is configured to match with an external thread of a main body of the water outlet device.

Furthermore, a major diameter of the internal thread is smaller than an internal diameter of a non-internal thread section of the columnar nut main body.

Furthermore, radial protrusions are disposed on an upper surface of the annular plate, the radial protrusions are configured to increase a friction force between the annular plate and a surface to be locked.

Furthermore, a first end of each of the radial protrusions is flush with an inner edge of the annular plate, and a second end of each of the radial protrusions radially extends toward an outer edge of the annular plate.

Furthermore, an internal diameter of the hexagonal bottom sleeve is greater than an internal diameter of the non-internal thread section of the columnar nut main body, and a minimum external diameter of the hexagonal bottom sleeve is greater than the external diameter of the columnar nut main body.

Furthermore, breaker bar receiving holes are respectively defined on two parallel outer walls of a hexagonal surrounding surface of the hexagonal bottom sleeve, the breaker bar receiving holes are perpendicular to an axis of the columnar nut main body and are configured to increase a maximum torque when tightening the thumb nut.

Furthermore, the height of the columnar nut main body is 1.5 to 2 times the external diameter of the columnar nut main body.

Furthermore, a reinforcing ring is disposed at a joint of the lower surface of the annular plate and the outer surface of the columnar nut main body, the reinforcing ring is configured to improve connecting strength of the annular plate and the columnar nut main body.

Furthermore, the annular plate, the radial protrusions, the reinforcing ring, the reinforcing ribs, the columnar nut main body, and the hexagonal bottom sleeve are integrally formed and are made of plastic material.

Based on above, the present disclosure provides the method of mounting the water outlet device, the water outlet device, and the thumb nut, in which the thumb nut is configured to mount the water outlet device, and the annular plate, the columnar nut main body, and the hexagonal bottom sleeve of the thumb nut are integrally formed and are made of the plastic material. The radial protrusions on the upper surface of the annular plate are capable of increasing the friction force between the annular plate and the sanitary appliance countertop, thereby better preventing the thumb nut from loosening. The height of the columnar nut main body is greater than the external diameter of the columnar nut main body, which is convenient for the users to manually rotate the thumb nut, in this way, an operation of mounting the thumb nut is convenient, thereby further saving efforts. Compared with a convenient method of mounting a faucet that uses a gasket and other accessories to cooperate with a screw nut, the present disclosure has advantages of preventing loosening, being low in labor intensity, and being convenient in assembling and disassembling.

BRIEF DESCRIPTION OF DRAWINGS

In order to more clearly illustrate embodiments of the present disclosure or technical solutions in the prior art, drawings required in description of the embodiments or the prior art are briefly described below, and obviously, the drawings in following description are merely some embodiments of the present disclosure, and for those who skilled in the art, other drawings may be obtained according to these drawings without creative efforts.

Figure 1:
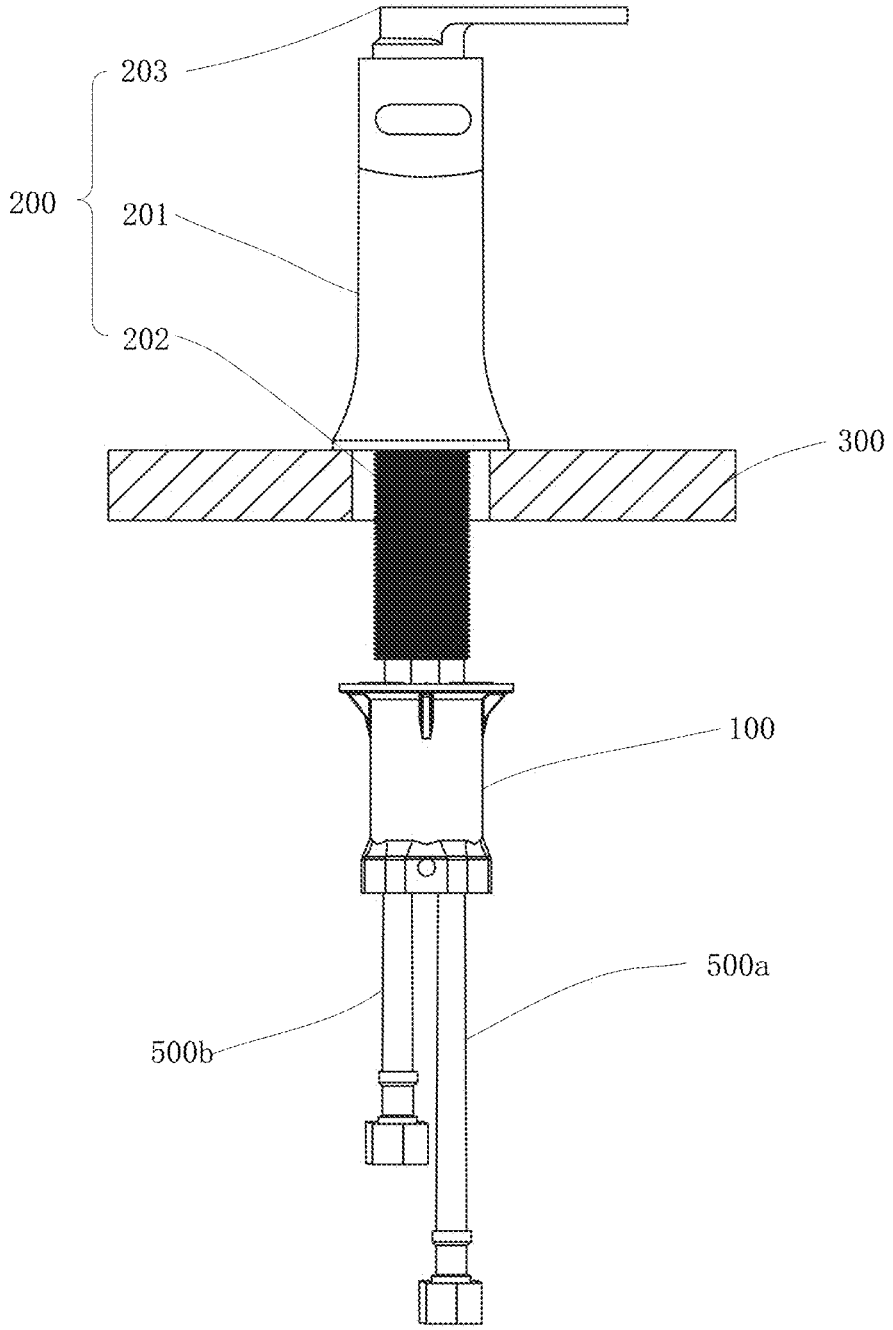
FIG. 1 is a structural schematic diagram of a water outlet device according to a first embodiment of the present disclosure.

Reference numerals in the drawings: 100. thumb nut; 1. annular plate; 2. columnar nut main body; 21. internal thread; 3. hexagonal bottom sleeve; 4. reinforcing rib; 41. radial edge; 42. axial edge; 43. curved edge; 5. radial protrusion; 6. breaker bar receiving hole; 7. reinforcing ring; 200. regulating valve; 201. valve body; 202. valve threaded body; 203. handle; 200*a*. hot water valve; 200*b*. cold water valve; 300. sanitary appliance countertop; 400. faucet spout; 401. spout threaded body; % 402. spout water inlet pipe; 500*a*. hot water inlet pipe; 600*a*. hot water outlet pipe; 500*b*. cold water inlet pipe; 600*b*. cold water outlet pipe; 700. three-way pipe; 701. first horizontal quick coupling; 702. second horizontal quick coupling; 703. vertical quick coupling; 101. first thumb nut; 102. second thumb nut; 103. second thumb nut.

DETAILED DESCRIPTION OF EMBODIMENTS

Technical solutions in embodiments of the present disclosure ARE clearly and completely described below with reference to accompanying drawings of the embodiments of the present disclosure, obviously, the described embodiments are only a part but not all of the embodiments of the present disclosure. All other embodiments obtained by those who skilled in the art based on the embodiments of the present disclosure without creative efforts shall fall within a protection scope of the present disclosure.

First Embodiment

Please refer to FIG. 1, the first embodiment provides a water outlet device capable of being quickly mounted, including a regulating valve 200 and a thumb nut 100, the regulating valve 200 and the thumb nut 100 cooperate with each other and are fixed in a mounting hole defined on a sanitary appliance countertop 300, and the mounting hole of the sanitary appliance countertop 300 is a single hole. Specifically, the regulating valve 200 includes a valve body 201 disposed at an upper portion thereof and a valve threaded body 202 disposed at a lower portion thereof, a handle is disposed on the valve body 201 for controlling the valve body 201, pipes are disposed at a lower end of the valve body 201 of the regulating valve 200, and the pipes extend downward. The pipes include at least one valve water inlet pipe, and the at least one valve water inlet pipe includes a hot water inlet pipe 500*a* and a cold water inlet pipe 500*b*, a distal end of the hot water inlet pipe 500*a* is communicated with a hot water source, and a distal end of the cold water inlet pipe 500*b* is communicated with a cold water source. The valve threaded body 202 of the regulating valve 200 cooperates with the thumb nut 100 to quickly fix the regulating valve 200 on the sanitary appliance countertop 300. When using the water outlet device, the handle 203 on the valve body 201 of the regulating valve 200 is controlled to drive the valve body 201 of the regulating valve 200 to communicate the hot water inlet pipe 500*a* and the cold water inlet pipe 500*b*, the valve body 201 of the regulating valve 200 mixes hot water and cold water respectively coming from the hot water source and the cold water source through the hot water inlet pipe 500*a* and the cold water inlet pipe 500*b* to obtain mixed water, and the mixed water flows out through a valve water outlet pipe of the regulating valve 200.

When mounting the water outlet device, the valve threaded body 202 of the regulating valve 200 and the pipes first pass from a top portion of the sanitary appliance countertop 300 to a lower portion of the sanitary appliance countertop 300, then the thumb nut 100 is sleeved onto the pipes and the valve threaded body 202 of the at least one regulating valve 200 from bottom to top at the lower portion of the sanitary appliance countertop 300, the thumb nut 100 is manually tightened to fix the regulating valve 200 on the sanitary appliance countertop 300, and finally, the distal end of the hot water inlet pipe 500*a* and the distal end of the cold water inlet pipe 500*b* are respectively communicated with the hot water source and the cold water source to finish mounting.

An external diameter of a lower portion of the valve body 201 of the regulating valve 200 of the first embodiment is greater than an internal diameter of the mounting hole of the sanitary appliance countertop 300, an external diameter of the valve threaded body 202 of the regulating valve 200 is smaller than the internal diameter of the mounting hole of the sanitary appliance countertop 300, so that the valve body 201 of the regulating valve 200 is disposed at the top portion of the sanitary appliance countertop 300, and the valve threaded body 202 of the regulating valve 200 is disposed at the lower portion of the sanitary appliance countertop 300.

In the water outlet device of the first embodiment, the regulating valve 200, the valve body 201, the valve thread body 202, the handle 203, and the valve water outlet pipe are integrated as a whole, the water outlet device of the first embodiment is referred to as an integrated faucet, in which the valve threaded body 202 cooperates with the thumb nut 100 to mount the integrated faucet in the single hole of the sanitary appliance countertop 300.

It should be noted that a pipe extending downward is generally disposed at a lower end of a valve body of a regulating valve of an integrated faucet in the prior art, in the embodiment, the pipes include the hot water inlet pipe 500*a* and the cold water inlet pipe 500*b*, or the pipes may be integrated to be a single pipe, a distal end of the single water pipe is connected to a tap water source, and at this time, the regulating valve 200 is configured to control a water flow rate of the integrated faucet of the present disclosure.

Figure 2:
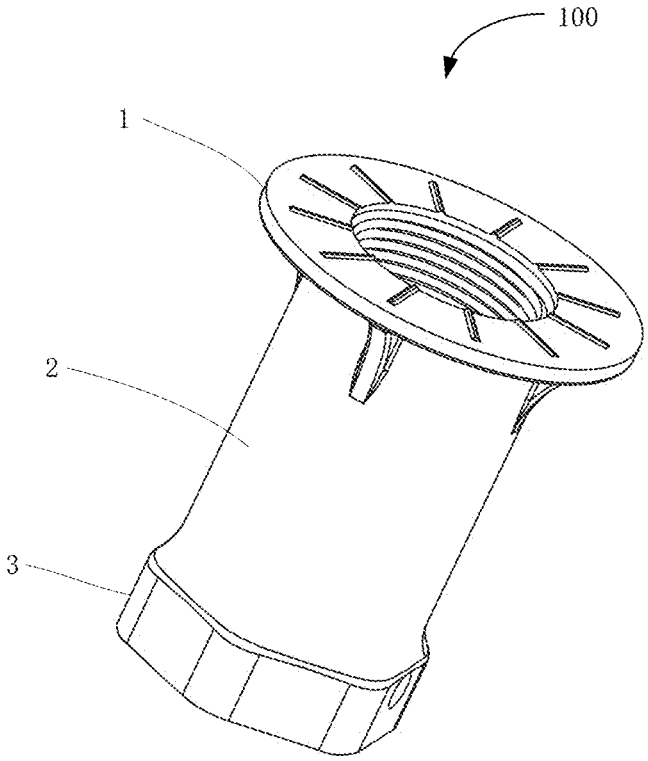
FIG. 2 is a first structural schematic diagram of a thumb nut of the water outlet device according to the first embodiment of the present disclosure.

As shown in FIGS. 1-2, the first embodiment further provides the thumb nut 100, including an annular plate 1, a columnar nut main body 2, and a hexagonal bottom sleeve 3. The annular plate 1, the columnar nut main body 2, and the hexagonal bottom sleeve 3 are vertically and coaxially connected in sequence. A height of the columnar nut main body 2 is greater than an external diameter of the columnar nut main body 2. Furthermore, the height of the columnar nut main body 2 is 1.5 to 2 times the external diameter of the columnar nut main body 2. The thumb nut 100 is screwed with the valve threaded body 202 of the regulating valve 200, which is convenient for users to manually rotate the thumb nut 100. An inner edge of the annular plate 1 is connected to a top portion of the columnar nut main body 2, an external diameter of the annular plate 1 is greater than the external diameter of the columnar nut main body 2. The annular plate 1 is configured to increase a contact area between the thumb nut 100 and a surface of the sanitary appliance countertop 300 to further increase a friction area for preventing loosening after tightening the thumb nut 100. The hexagonal bottom sleeve 3 is disposed at a bottom portion of the columnar nut main body 2, that is, a top portion of the hexagonal bottom sleeve 3 is connected to the bottom portion of the columnar nut main body 2. The hexagonal bottom sleeve 3 is a polygon and is preferably hexagonal-shaped. The hexagonal bottom sleeve 3 is configured to increase a running torque of the thumb nut 100 when tightening the thumb nut 100.

Figure 3:
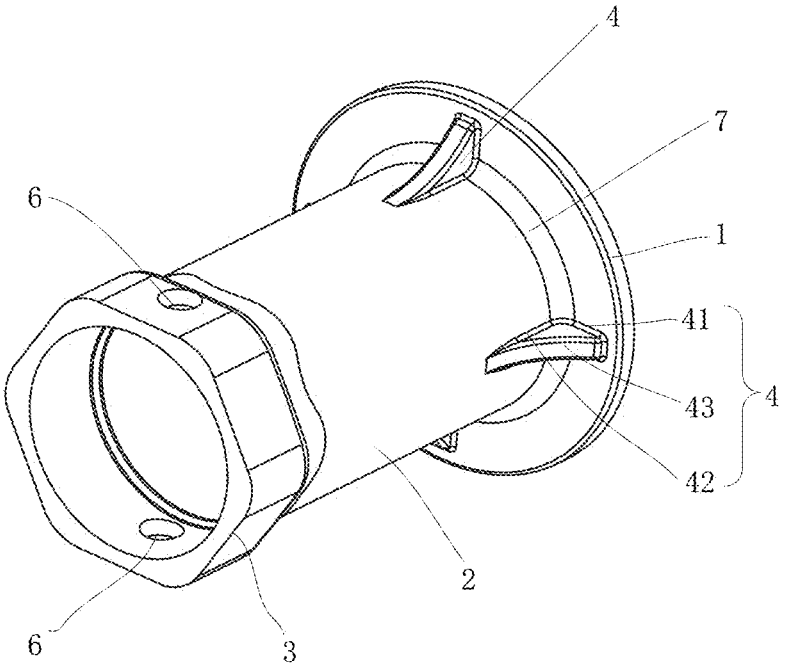
FIG. 3 is a second structural schematic diagram of the thumb nut of the water outlet device according to the first embodiment of the present disclosure.

As shown in FIG. 3, furthermore, reinforcing ribs 4 are disposed between an outer surface of the columnar nut main body 2 and a lower surface of the annular plate 1, in one embodiment, the reinforcing ribs 4 are uniformly distributed between the outer surface of the columnar nut main body 2 and the lower surface of the annular plate 1, and the reinforcing ribs 4 are configured to improve rigidity of the annular plate 1. Specifically, each of the reinforcing ribs 4 includes a radial edge 41, an axial edge 42, and a curved edge 43. Each radial edge 41 radially extends along the lower surface of the annular plate 1. Each axial edge 42 is connected to a corresponding radial edge 41 and extends along a corresponding generatrix of the columnar nut main body 2. Each curved edge 43 is curved inward and is respectively connected to an end of the corresponding radial edge 41 and an end of a corresponding axial edge 42.

As shown in FIG. 3, a reinforcing ring 7 is disposed at a joint of the lower surface of the annular plate 1 and the outer surface of the columnar nut main body 2, the reinforcing ring 7 is configured to improve connecting strength of the annular plate 1 and the columnar nut main body 2.

Figure 4:
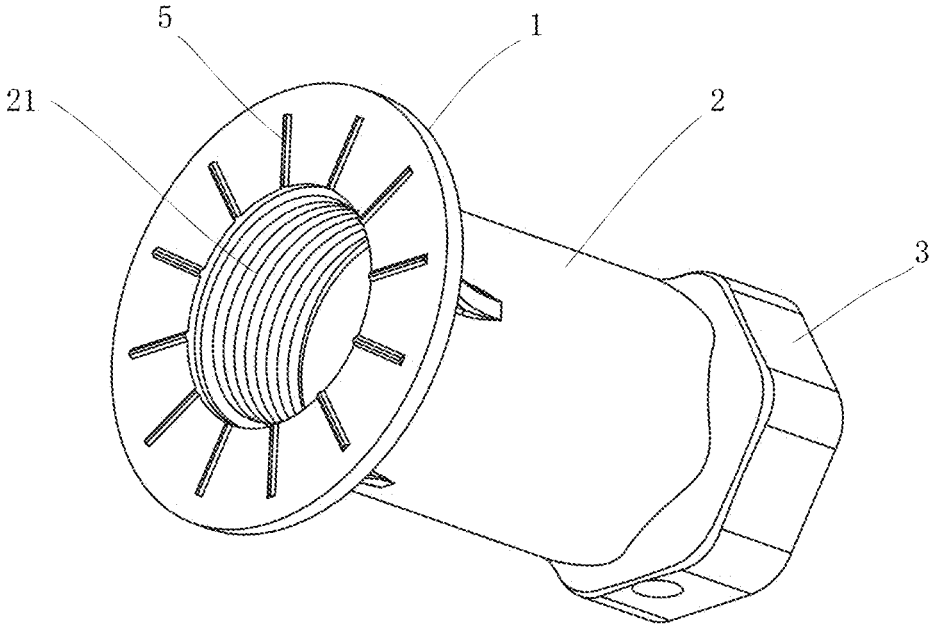
FIG. 4 is a third structural schematic diagram of the thumb nut of the water outlet device according to the first embodiment of the present disclosure.
Figure 5:
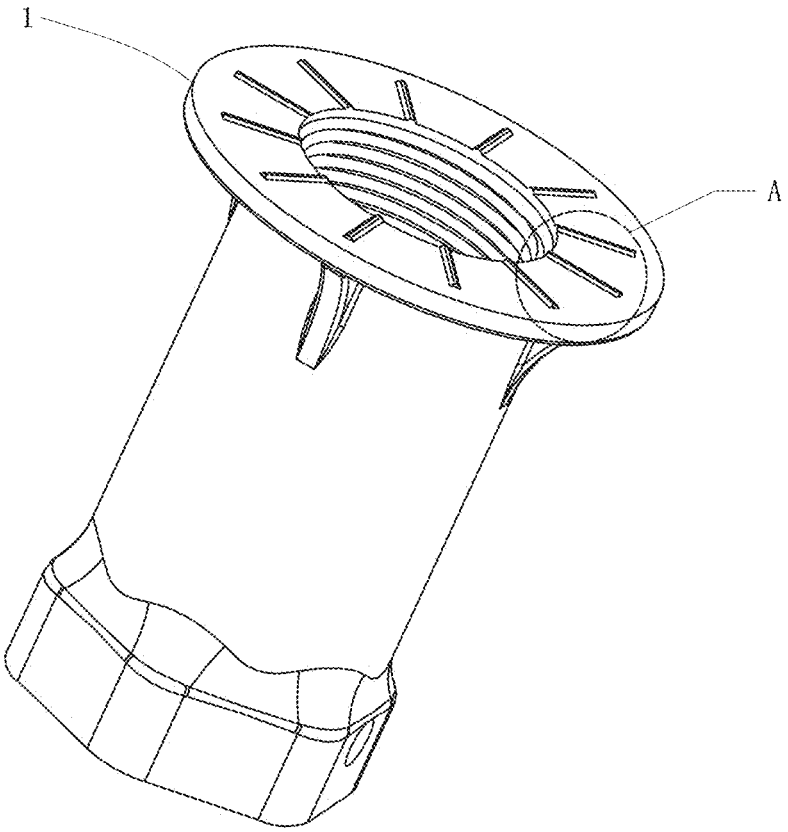
FIG. 5 is a fourth structural schematic diagram of the thumb nut of the water outlet device according to the first embodiment of the present disclosure.
Figure 6:
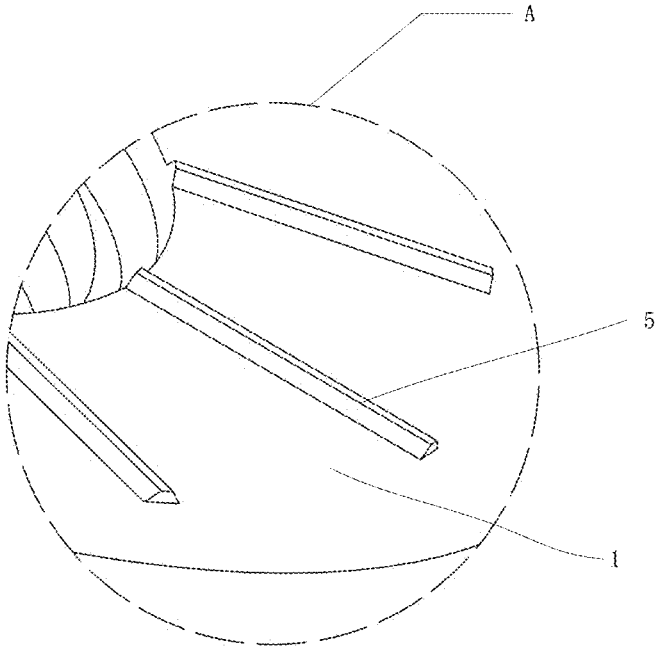
FIG. 6 is an enlarged schematic diagram of portion A shown in FIG. 5.
Figure 7:
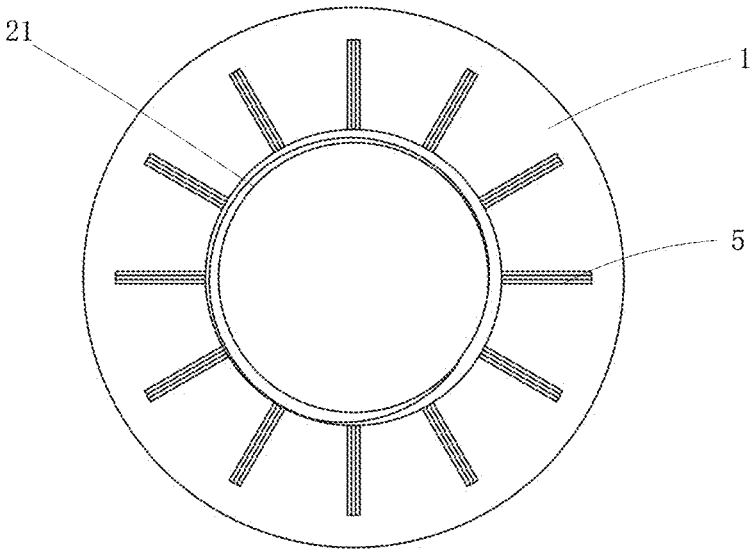
FIG. 7 is a fifth structural schematic diagram of the thumb nut of the water outlet device according to the first embodiment of the present disclosure.
Figure 8:
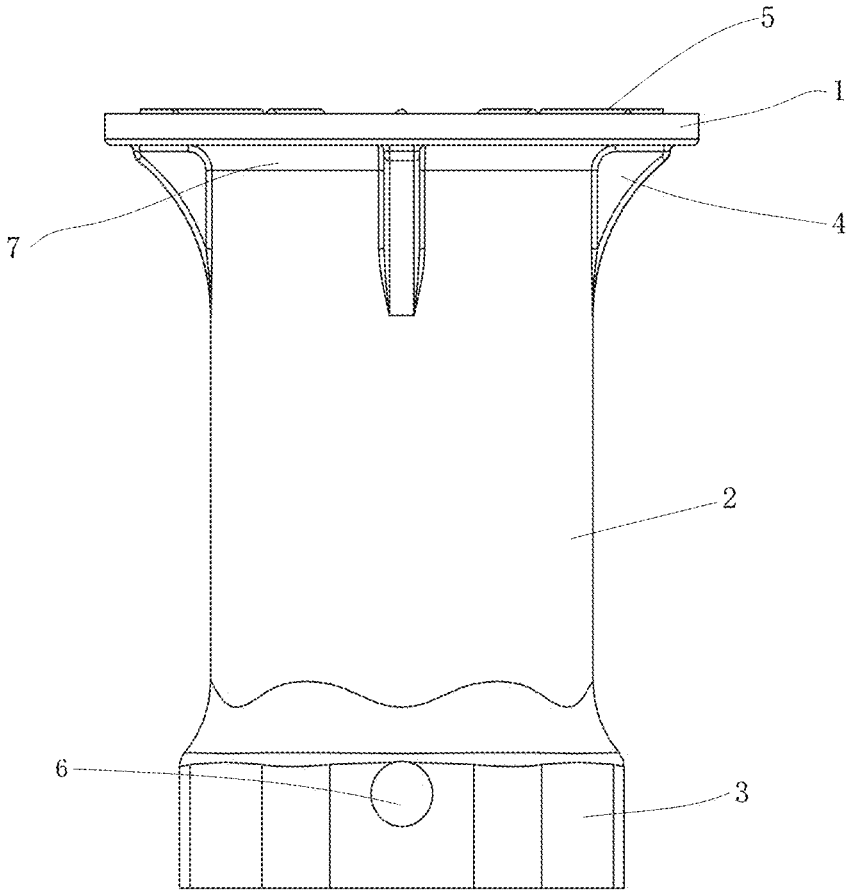
FIG. 8 is a sixth structural schematic diagram of the thumb nut of the water outlet device according to the first embodiment of the present disclosure.

As shown in FIGS. 1 and 4, an internal thread 21 is disposed on an inner hole wall of an upper section of the columnar nut main body 2, and the internal thread 21 is configured to match with the valve threaded body 202 of the regulating valve 200 at the lower end of the sanitary appliance countertop 300, that is, the columnar nut main body 2 is screwed with the valve threaded body 202 of the regulating valve 200, the internal thread 21 extends upward to an inner side surface of the annular plate 1, an internal diameter of the annular plate 1 is equal to an internal diameter of the columnar nut main body 2. A major diameter of the internal thread 21 of the columnar nut main body 2 is smaller than an internal diameter of a non-internal thread section of the columnar nut main body 2.

As shown in FIGS. 1 and 5-7, radial protrusions 5 are disposed on an upper surface of the annular plate 1, the radial protrusions 5 are configured to increase a friction force between the thumb nut 100 and a lower surface of the sanitary appliance countertop 300, thereby preventing the thumb nut 100 from easily loosening from the valve threaded body 202 of the regulating valve 200 after the thumb nut 100 is screwed with the valve threaded body 202 of the regulating valve 200, the radial protrusions 5 are radially distributed on the upper surface of the annular plate 1. A first end of each of the radial protrusions 5 is flush with an inner edge of the annular plate 1, and a second end of each of the radial protrusions 5 radially extends toward an outer edge of the annular plate 1.

Furthermore, an area of a cross section of each of the radial protrusions 5 gradually increases from a top portion thereof to a bottom portion thereof, the top portion of each of the radial protrusions 5 is plane or curved, and preferably, the top portion of each of the radial protrusions 5 is curved.

As shown in FIGS. 1 and 3, in the first embodiment, an internal diameter of the hexagonal bottom sleeve 3 is greater than an internal diameter of the non-internal thread section of the columnar nut main body 2, and a minimum external diameter of the hexagonal bottom sleeve 3 is greater than the external diameter of the columnar nut main body 2. Breaker bar receiving holes 6 are respectively defined on two parallel outer walls of a hexagonal surrounding surface of the hexagonal bottom sleeve 3, the breaker bar receiving holes 6 are perpendicular to an axis of the columnar nut main body 2 and are configured to cooperate with a breaker bar to increase a maximum torque when tightening the thumb nut 100. When using the thumb nut 100, the valve threaded body 202 of the regulating valve 200 of the water outlet device is matched with the thumb nut 100, and the users hold the columnar nut main body 2 of the thumb nut 100 by hands to rotate the thumb nut 100, so that the thumb nut 100 is screwed with the valve threaded body 202 of the regulating valve 200 to fix the regulating valve 200 on the sanitary appliance countertop 300.

Furthermore, a movable wrench or an open-end wrench is provided for cooperating with the hexagonal bottom sleeve 3 for rotation, or, the breaker bar is provided to cooperate with the hexagonal bottom sleeve 3 for rotation, so as to increase the running torque of the thumb nut 100, and the thumb nut 100 cooperates with the valve threaded body 202 of the regulating valve 200 to firmly fix the regulating valve 200 on the sanitary appliance countertop 300.

As shown in FIGS. 2-4 and 8, the annular plate 1, the radial protrusions 5, the reinforcing ring 7, the reinforcing ribs 4, the columnar nut main body 2, and the hexagonal bottom sleeve 3 are integrally formed and are made of plastic material. Preferably, the annular plate 1, the radial protrusions 5, the reinforcing ring 7, the reinforcing ribs 4, the columnar nut main body 2, and the hexagonal bottom sleeve 3 are integrally formed and are made of high-toughness plastic material, the thumb nut 100 has high strength, high toughness, and aging resistance, thereby prolonging a service life thereof.

In the prior art, tools, such as wrenches, screwdrivers, etc., are provided for assembling a faucet main body, a gasket, and a screw nut, since there is a large number of accessories, operation in a narrow space below a basin wastes time and labor and has low mounting efficiency. As shown in FIG. 1, the water outlet device of the first embodiment is the integrated faucet, the valve body 201 of the regulating valve 200 is disposed on the sanitary appliance countertop 300, the valve threaded body 202 of the regulating valve 200 passes from the top portion of the sanitary appliance countertop 300 to the lower portion of the sanitary appliance countertop 300, and the thumb nut 100 is manually tightened to fix the integrated faucet on the sanitary appliance countertop 300. The present disclosure has advantages of easy and convenient mounting and high efficiency.

Second Embodiment

Figure 9:
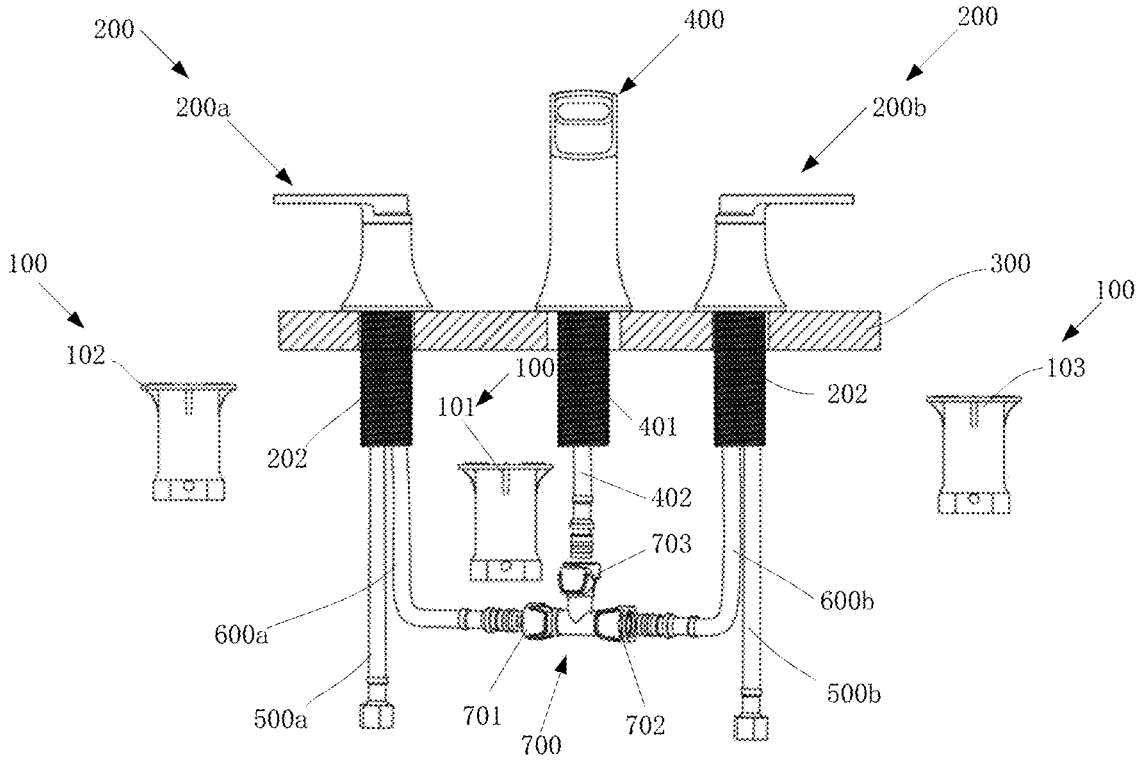
FIG. 9 is a structural schematic diagram of the water outlet device according to a second embodiment of the present disclosure.

As shown in FIGS. 1 and 9, the second embodiment provides a water outlet device, capable of being quickly mounted, including at least one thumb nut 100 having the same structure of the thumb nut 100 provided in the first embodiment, therefore, the structure of the hand nut 100 is not described again. Difference lies in that the water outlet device of the first embodiment and the water outlet device of the second embodiment is that the water outlet device of the first embodiment is the integrated faucet, the integrated faucet is disposed in the single hole of the sanitary appliance countertop 300, but the water outlet device of the second embodiment is a three-hole faucet, a hot water valve 200*a*, a cold water valve 200*b*, and a faucet spout 400 of the three-hole faucet are respectively disposed in three mounting holes of a three-hole sanitary appliance countertop 300.

As shown in FIG. 9, in the second embodiment, the water outlet device includes the faucet spout 400, at least one regulating valve 200, and the at least one thumb nut 100, the faucet spout 400, the at least one regulating valve 200, and the at least one thumb nut 100 are respectively disposed on the three-hole sanitary appliance countertop 300. The three mounting holes of the three-hole sanitary appliance countertop 300 include a left mounting hole, a middle mounting hole, and a right mounting hole. The at least one regulating valve 200 includes the hot water valve 200*a* and the cold water valve 200*b*. The at least one thumb nut 100 includes two first thumb nuts 102, 103 and a second thumb nut 101. The water outlet device further includes a three-way pipe 700 configured to mix cold water and hot water, the three-way pipe 700 includes a first horizontal quick coupling 701, a second horizontal quick coupling 702, and a vertical quick coupling 703.

Specifically, a spout threaded body 401 at a lower end of the faucet spout 400 passes through the middle mounting hole of the three-hole sanitary appliance countertop 300, the spout threaded body 401 of the faucet spout 400 is disposed at the lower portion of the three-hole sanitary appliance countertop 300, the second thumb nut 101 is provided to fix the faucet spout 400 on the three-hole sanitary appliance countertop 300, a spout water inlet pipe 402 is disposed in the spout threaded body 401 of the faucet spout 400, the spout water inlet pipe 402 extends downward.

The hot water valve 200*a* and the cold water valve 200*b* are respectively disposed in the left mounting hole and the right mounting hole at two sides of the faucet spout 400, a hot water inlet pipe 500*a* extending downward and a hot water outlet pipe 600*a* extending downward are fixed in a valve threaded body 202 of the hot water valve 200*a*, both a distal end of the hot water inlet pipe 500*a* and a distal end of the hot water outlet pipe 600*a* are male connectors. The hot water inlet pipe 500*a* and the hot water outlet pipe 600*a* are disposed at a lower end of the hot water valve 200*a*, the hot water inlet pipe 500*a* is communicated with a hot water source, and the hot water outlet pipe 600*a* is communicated with the spout water inlet pipe 402. A cold water inlet pipe 500*b* extending downward and a cold water outlet pipe 600*b* extending downward are fixed in a valve threaded body 202 of the cold water valve 200*b*, both a distal end of the cold water inlet pipe 500*b* and a distal end of the cold water outlet pipe 600*b* are male connectors. The cold water inlet pipe 500*b* and the cold water outlet pipe 600*b* are disposed at a lower end of the cold water valve 200*b*, the cold water inlet pipe 500*b* is communicated with a cold water source, and the cold water outlet pipe 600*b* is communicated with the spout water inlet pipe 402.

In the second embodiment, the valve threaded body 202 at the lower end of the hot water valve 200*a*, the distal end of the hot water inlet pipe 500*a*, and the distal end of the hot water outlet pipe 600*a* pass from the top portion of the three-hole sanitary appliance countertop 300 to the lower portion of the three-hole sanitary appliance countertop 300 through the left mounting hole of the three-hole sanitary appliance countertop 300, and one first thumb nut 102 cooperates with the valve threaded body 202 of the hot water valve 200*a* to fix the hot water valve 200*a* on the three-hole sanitary appliance countertop 300. The valve threaded body 202 at the lower end of the cold water valve 200*b*, the distal end of the cold water inlet pipe 500*b*, and the distal end of the cold water outlet pipe 600*b* pass from the top portion of the three-hole sanitary appliance countertop 300 to the lower portion of the three-hole sanitary appliance countertop 300 through the right mounting hole of the three-hole sanitary appliance countertop 300, and one first thumb nut 103 cooperates with the valve threaded body 202 of the cold water valve 200*b* to fix the cold water valve 200*b* on the three-hole sanitary appliance countertop 300. The first horizontal quick coupling 701 of the three-way pipe 700 is connected to the distal end of the hot water outlet pipe 600*a* at the lower end of the hot water valve 200*a*, the second horizontal quick coupling 702 of the three-way pipe 700 is connected to the distal end of the cold outlet pipe 600*b*, the vertical quick coupling 703 of the three-way pipe 700 is connected to a distal end of the spout inlet pipe 402 of the faucet spout 400.

It should be noted that, in the second embodiment, the two first thumb nuts 102, 103 and the second thumb nut 101 are provided, the two first thumb nuts 102, 103 are respectively configured to lock the hot water valve 200*a* and the cold water valve 200*b*, the second thumb nut 101 is configured to lock the faucet spout 400, structures of the two first thumb nuts 102, 103 and the second thumb nut 101 are the same, and in order to distinguish the two first thumb nuts 102, 103 and the second thumb nut 101, different colors are selected to show differences. For example, the one first thumb nut 102 for locking the hot water valve 200*a* is red, the one first thumb nut 103 for locking the cold water valve 200*b* is blue, and the second thumb nut 101 for locking the faucet spout 400 is black.

The second embodiment provides the three-hole faucet, in the prior art, the tools, such as the wrenches, the screwdrivers, etc., are provided for assembling a regulating valve, a faucet spout, a gasket ring, and a screw nut, since there is a large number of accessories, operation in a narrow space below a basin wastes time and labor and has low mounting efficiency. However, according to the three-hole faucet of the second embodiment, the hot water valve 200*a*, the faucet spout 400, and the cold water valve 200*b* respectively passes through the left mounting hole, the middle mounting hole, and the right mounting hole of the three-hole sanitary appliance countertop 300 from the top portion of the three-hole sanitary appliance countertop 300. The valve threaded body 202 of the hot water valve 200*a*, the spout threaded body 401 of the faucet spout 400, and the valve threaded body 202 of the cold water valve 200*b* are disposed at the lower portion of the three-hole sanitary appliance countertop 300 and respectively cooperate with the two first thumb nuts 102, 103 and the second thumb 101, the two first thumb nuts 102, 103 and the second thumb 101 are manually tightened to fix the three-hole faucet on the three-hole sanitary appliance countertop 300. Moreover, the distal end of hot water outlet pipe 600*a*, the distal end of the cold water outlet pipe 600*b*, and the distal end of the spout water inlet pipe 402 are connected through the three-way pipe 700, which is simple in operation and is high in mounting efficiency.

Third Embodiment

As shown in FIG. 1, the third embodiment provides a method of mounting the water outlet device of the first embodiment, including following steps.

- S10: passing the valve threaded body 202 of the regulating valve 200, the hot water inlet pipe 500*a*, and the cold water inlet pipe 500*b* from the top portion of the sanitary appliance countertop 300 to the lower portion of the sanitary appliance countertop 300.
- S20: manually sleeving the thumb nut 100 onto the hot water inlet pipe 500*a*, the cold water inlet pipe 500*b*, and the valve threaded body 202 from the bottom to the top at the lower portion of the sanitary appliance countertop 300.
- S30: manually tightening the thumb nut 100 to fix the at least one regulating valve 200 on the sanitary appliance countertop 300, respectively connecting distal end of the hot water inlet pipe 500*a* and the cold water inlet pipe 500*b* to the hot water source and the cold water source to finish mounting.

The water outlet device of the third embodiment is the integrated faucet, and the integrated faucet may include one water inlet pipe or two water inlet pipes. In the third embodiment, the integrated faucet includes two water inlet pipes, the two water inlet pipes include the hot water inlet pipe 500*a* configured to communicate with the hot water source and the cold water inlet pipe 500*b* configured to communicate with the cold water source. The method of mounting the integrated faucet is simple and convenient in operation and high in efficiency.

Fourth Embodiment

As shown in FIG. 9, the fourth embodiment provides a method of mounting the water outlet device of the second embodiment, including following steps

- S11: passing the valve threaded body 202 at the lower end of the hot water valve 200*a*, the distal end of the hot water inlet pipe 500*a*, and the distal end of the hot water outlet pipe 600*a* from the top portion of the three-hole sanitary appliance countertop 300 to the lower portion of the three-hole sanitary appliance countertop 300.
- S12: passing the valve threaded body 202 at the lower end of the cold water valve 200*b*, the distal end of the cold water inlet pipe 500*b*, and the distal end of the cold water outlet pipe 600*b* from the top portion of the three-hole sanitary appliance countertop 300 to the lower portion of the three-hole sanitary appliance countertop 300.
- S21: manually sleeving the one first thumb nut 102 onto the hot water inlet pipe 500*a*, the hot water outlet pipe 600*a*, and the valve threaded body 202 at the lower end of the hot water valve 200*a* from the bottom to the top at the lower portion of the three-hole sanitary appliance countertop 300.
- S22: manually sleeving the one first thumb nut 103 onto the cold water inlet pipe 500*b*, the cold water outlet pipe 600*b*, and the valve threaded body 202 at the lower end of the cold water valve 200*b* from the bottom to the top at the lower portion of the three-hole sanitary appliance countertop 300.
- S31: manually tightening the one first thumb nut 102 to quickly fix the hot water valve 200*a* on the three-hole sanitary appliance countertop 300.
- S32: manually tightening the one first thumb nut 103 to quickly fix the hot water valve 200*b* on the three-hole sanitary appliance countertop 300.
- S40: passing the spout threaded body 401 of the faucet spout 400 and the spout water inlet pipe 402 from the top portion of the three-hole sanitary appliance countertop 300 to the lower portion of the three-hole sanitary appliance countertop 300 through the middle mounting hole of the three-hole sanitary appliance countertop 300.
- S50: manually sleeving the second thumb nut 101 onto the spout water inlet pipe 402 and the spout threaded body 401 of the faucet spout 400 from the bottom to the top at the lower portion of the three-hole sanitary appliance countertop 300.
- S60: manually tightening the second thumb nut 101 to fix the faucet spout 400 on the three-hole sanitary appliance countertop 300.
- S70: connecting the first horizontal quick coupling 701 of the three-way pipe 700 to the distal end of the hot water outlet pipe 600*a* at the lower end of the hot water valve 200*a*.
- S80: connecting the second horizontal quick coupling 702 of the three-way pipe 700 to the distal end of the cold water outlet pipe 600*b* at the lower end of the cold water valve 200*b*.
- S90: connecting the vertical quick coupling 703 of the three-way pipe 700 to the distal end of the spout water inlet pipe 402.

It should be noted that, in the fourth embodiment, the water outlet device is the three-hole faucet, and in the method of mounting the three-hole faucet, the S11 and the S12 are not required to be performed in sequence, the S21 and the S22 are not required to be performed in sequence, and the S11, the S12, and the S40 are not required to be performed in sequence. That is, when mounting the three-hole faucet on the three-hole sanitary appliance countertop 300, the hot water valve 200*a*, the cold water valve 200*b*, and the faucet spout 400 are respectively disposed in the three mounting holes of the three-hole sanitary appliance countertop 300, and there is no specific mounting sequence required therefor, which is beneficial for quickly mounting the three-hole faucet.

Compared with the prior art, the method of mounting the three-hole faucet of the fourth embodiment requires fewer mounting accessories, is simpler to operate, and is higher in the mounting efficiency.

The above are only preferred embodiments of the present disclosure and are not intended to limit the present disclosure, and any modifications, equivalent replacements, improvements, etc. made within a spirit and principle of the present disclosure shall fall within a protection scope of the present disclosure.

What is claimed is:

1. A method of mounting water outlet device, comprising:

S10: passing a valve threaded body of at least one regulating valve and pipes from a top portion of a sanitary appliance countertop to a lower portion of the sanitary appliance countertop, wherein the valve threaded body of the at least one regulating valve is disposed at a lower end of the at least one regulating valve and is disposed out of a valve body of the at least one regulating valve and the pipes extend downward;

S20: manually sleeving a first thumb nut onto the pipes and the valve threaded body of the at least one regulating valve from bottom to top at the lower portion of the sanitary appliance countertop; and S30: manually tightening the first thumb nut to fix the at least one regulating valve on the sanitary appliance countertop;

wherein the first thumb nut comprises an annular plate, a columnar nut main body, and a hexagonal bottom sleeve, and the annular plate, the columnar nut main body, and the hexagonal bottom sleeve are vertically and coaxially connected in sequence;

wherein a tightening method of the first thumb nut comprises:

manually rotating the hexagonal bottom sleeve to dive the first thumb nut to rotate; and enabling radial protrusions disposed on an upper surface of the annular plate being abutted against the valve threaded body of the at least one regulating valve to increase a friction force between the annular plate and the valve threaded body of the at least one regulating valve.

2. The method of mounting the water outlet device according to claim 1, wherein in the S10, the at least one regulating valve comprises a hot water valve and a cold water valve, the pipes comprise a hot water inlet pipe extending downward, a cold water inlet pipe extending downward, a hot water outlet pipe extending downward, and a cold water outlet pipe extending downward, and an assembly step of the hot water valve, the cold water valve, and the pipes comprises:

S11: passing the valve threaded body of the hot water valve, the hot water inlet pipe, and the hot water outlet pipe from the top portion of the sanitary appliance countertop to the lower portion of the sanitary appliance countertop, wherein the valve threaded body of the hot water valve is disposed at a lower end of the hot water valve; and S12: passing the valve threaded body of the cold water valve, the cold water inlet pipe, and the cold water outlet pipe from the top portion of the sanitary appliance countertop to the lower portion of the sanitary appliance countertop, wherein the valve threaded body of the cold water valve is disposed at a lower end of the cold water valve.

3. The method of mounting the water outlet device according to claim 1, wherein the method of mounting the water outlet device further comprises:

S40: passing a spout threaded body of a faucet spout and a spout water inlet pipe from the top portion of the sanitary appliance countertop to the lower portion of the sanitary appliance countertop, wherein the spout threaded body of the faucet spout is disposed at a lower end of the faucet spout and the spout water inlet pipe extends downward;

S50: manually sleeving a second thumb nut onto the spout water inlet pipe and the spout threaded body of the faucet spout from the bottom to the top at the lower portion of the sanitary appliance countertop; and S60: manually tightening the second thumb nut to fix the faucet spout on the sanitary appliance countertop.

4. The method of mounting the water outlet device according to claim 3, wherein the method of mounting the water outlet device further comprises:

S70: connecting a first horizontal quick coupling of a three-way pipe to a distal end of a hot water outlet pipe at a lower end of a hot water valve;

S80: connecting a second horizontal quick coupling of the three-way pipe to a distal end of a cold water outlet pipe at a lower end of a cold water valve; and S90: connecting a vertical quick coupling of the three-way pipe to a distal end of the spout water inlet pipe.

5. A water outlet device, comprising:

at least one regulating valve;

at least one first thumb nut; and pipes;

wherein the at least one regulating valve comprises a valve body, the valve body is disposed on a sanitary appliance countertop and is configured to control a water flow rate of the water outlet device;

the at least one regulating valve further comprises a valve threaded body, the valve threaded body is disposed at a lower end of the at least one regulating valve, the valve threaded body passes through the sanitary appliance countertop from a top portion of the sanitary appliance countertop to a lower portion of the sanitary appliance countertop, and the at least one first thumb nut is configured to be manually tightened to fix the at least one regulating valve on the sanitary appliance countertop;

the at least one first thumb nut comprises an annular plate, a columnar nut main body, and a hexagonal bottom sleeve, wherein the annular plate, the columnar nut main body, and the hexagonal bottom sleeve are vertically and coaxially connected in sequence; radial protrusions are disposed on an upper surface of the annular plate, the radial protrusions are configured to increase a friction force between the annular plate and the valve threaded body of the at least one regulating valve;

the pipes extend downward;

the water outlet device applies a method of mounting, comprises:

passing the valve threaded body of the at least one regulating valve and the pipes from the top portion of the sanitary appliance countertop to the lower portion of the sanitary appliance countertop;

sleeving the at least one first thumb nut onto the pipes and the valve threaded body from bottom to top at the lower portion of the sanitary appliance countertop; and manually tightening the at least one first thumb nut to fix the at least one regulating valve on the sanitary appliance countertop.

6. The water outlet device according to claim 5, wherein the pipes comprise at least one valve water inlet pipe and at least one valve water outlet pipe;

the at least one valve water inlet pipe and the at least one valve water outlet pipe are fixed in the valve threaded body of the at least one regulating valve, both the at least one valve water inlet pipe and the at least one valve water outlet pipe extend downward; and a distal end of the at least one valve water inlet pipe is a first male connector, and a distal end of the at least one valve outlet pipe is a second male connector.

7. The water outlet device according to claim 6, wherein the water outlet device further comprises a faucet spout and a second thumb nut;

a spout threaded body of the faucet spout passes through the sanitary appliance countertop and is disposed at the lower portion of the sanitary appliance countertop, the second thumb nut is manually tightened to fix the faucet spout on the sanitary appliance countertop; and a spout water inlet pipe is disposed in the spout threaded body of the faucet spout, the spout water inlet pipe extends downward, and a distal end of the spout water inlet pipe is a third male connector.

8. The water outlet device according to claim 7, wherein the at least one regulating valve comprises a hot water valve and a cold water valve, the hot water valve and the cold water valve are respectively disposed at two sides of the faucet spout, the at least one valve water inlet pipe comprises a hot water inlet pipe and a cold water inlet pipe, and the at least one valve water outlet pipe comprises a hot water outlet pipe and a cold water outlet pipe;

the hot water inlet pipe and the hot water outlet pipe are disposed at a lower end of the hot water valve, the hot water inlet pipe is communicated with a hot water source, and the hot water outlet pipe is communicated with the spout water inlet pipe;

the cold water inlet pipe and the cold water outlet pipe are disposed at a lower end of the cold water valve, the cold water inlet pipe is communicated with a cold water source, and the cold water outlet pipe is communicated with the spout water inlet pipe;

the water outlet device further comprises a three-way pipe, the three-way pipe comprises a first horizontal quick coupling, a second horizontal quick coupling, and a vertical quick coupling, the first horizontal quick coupling, the second horizontal quick coupling, and the vertical quick coupling are all female connectors and are configured to mix cold water and hot water;

the first horizontal quick coupling is configured to connect to a distal end of the hot water outlet pipe;

the second horizontal quick coupling is configured to connect to a distal end of the cold water outlet pipe; and the vertical quick coupling is configured to connect to the distal end of the spout water inlet pipe.

9. A thumb nut, for mounting a water outlet device, comprising:

an annular plate;

a columnar nut main body; and a hexagonal bottom sleeve;

wherein the annular plate, the columnar nut main body, and the hexagonal bottom sleeve are vertically and coaxially connected in sequence;

a height of the columnar nut main body is greater than an external diameter of the columnar nut main body;

the annular plate is configured to increase a friction area for preventing loosening after tightening the thumb nut, and an inner edge of the annular plate is connected to a top portion of the columnar nut main body; and the hexagonal bottom sleeve is configured to increase a running torque when tightening the thumb nut, a top portion of the hexagonal bottom sleeve is connected to a bottom portion of the columnar nut main body;

wherein radial protrusions are disposed on an upper surface of the annular plate, the radial protrusions are configured to increase a friction force between the annular plate and a surface to be locked.

10. The thumb nut according to claim 9, wherein reinforcing ribs are disposed between an outer surface of the columnar nut main body and a lower surface of the annular plate, and the reinforcing ribs are configured to improve rigidity of the annular plate.

11. The thumb nut according to claim 10, wherein each of the reinforcing ribs comprises a radial edge, an axial edge, and a curved edge;

each radial edge radially extends along the lower surface of the annular plate;

each axial edge is connected to a corresponding radial edge and extends along a corresponding generatrix of the columnar nut main body; and each curved edge is curved inward and is respectively connected to an end of the corresponding radial edge and an end of a corresponding axial edge.

12. The thumb nut according to claim 11, wherein an internal thread is disposed on an inner hole wall of an upper section of the columnar nut main body, and the internal thread is configured to match with an external thread of a main body of the water outlet device.

13. The thumb nut according to claim 12, wherein a major diameter of the internal thread is smaller than an internal diameter of a non-internal thread section of the columnar nut main body.

14. The thumb nut according to claim 9, wherein a first end of each of the radial protrusions is flush with an inner edge of the annular plate, and a second end of each of the radial protrusions radially extends toward an outer edge of the annular plate.

15. The thumb nut according to claim 14, wherein an internal diameter of the hexagonal bottom sleeve is greater than an internal diameter of the non-internal thread section of the columnar nut main body, and a minimum external diameter of the hexagonal bottom sleeve is greater than the external diameter of the columnar nut main body.

16. The thumb nut according to claim 15, wherein breaker bar receiving holes are respectively defined on two parallel outer walls of a hexagonal surrounding surface of the hexagonal bottom sleeve, the breaker bar receiving holes are perpendicular to an axis of the columnar nut main body and are configured to increase a maximum torque when tightening the thumb nut.

17. The thumb nut according to claim 16, wherein the height of the columnar nut main body is 1.5 to 2 times the external diameter of the columnar nut main body.

18. The thumb nut according to claim 17, wherein a reinforcing ring is disposed at a joint of the lower surface of the annular plate and the outer surface of the columnar nut main body, the reinforcing ring is configured to improve connecting strength of the annular plate and the columnar nut main body.

19. The thumb nut according to claim 18, wherein the annular plate, the radial protrusions, the reinforcing ring, the reinforcing ribs, the columnar nut main body, and the hexagonal bottom sleeve are integrally formed and are made of plastic material.

* * * * *